US006827605B2

(12) United States Patent
Wu

(10) Patent No.: US 6,827,605 B2
(45) Date of Patent: Dec. 7, 2004

(54) STACKED ELECTRICAL CONNECTOR WITH ENHANCED HOUSING STRUCTURE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/405,786

(22) Filed: Apr. 1, 2003

(65) Prior Publication Data

US 2004/0097128 A1 May 20, 2004

Related U.S. Application Data

(63) Continuation-in-part of application No. 10/295,737, filed on Nov. 15, 2002.

(51) Int. Cl.[7] ..... H01R 13/60; H01R 13/66
(52) U.S. Cl. ..... 439/567; 439/541.5
(58) Field of Search ..... 439/541.5, 79, 439/567

(56) References Cited

U.S. PATENT DOCUMENTS 4,802,860 A * 2/1989 Kikuta ..... 439/79
5,213,515 A * 5/1993 Ishikawa et al. ..... 439/79
5,346,404 A * 9/1994 Shimada ..... 439/108
5,354,207 A * 10/1994 Chikano ..... 439/79
5,688,129 A * 11/1997 Flaherty ..... 439/79
6,053,773 A * 4/2000 Wu ..... 439/609
6,086,418 A * 7/2000 Chang ..... 439/573
6,183,270 B1 * 2/2001 Huang et al. ..... 439/79
6,524,130 B1 * 2/2003 Yeh ..... 439/541.5
6,663,423 B2 * 12/2003 Belopolsky et al. ..... 439/541.5

FOREIGN PATENT DOCUMENTS

| | | |
|---|---|---|
| TW | 493301 | 7/2002 |
| TW | 493804 | 7/2002 |
| TW | 509393 | 11/2002 |

* cited by examiner

*Primary Examiner*—Hae Moon Hyeon
(74) *Attorney, Agent, or Firm*—Wei Te Chung

(57) ABSTRACT

An electrical connector (1) includes an insulative housing (10), a number of terminals (20) received in the housing, a spacer (30), and a pair of board locks (40) secured to the housing. The housing includes a pair of side walls (11), a partition wall (12) horizontally extending between the two side walls, and a middle wall (13) extending perpendicularly to the partition wall. The housing defines a first cavity (103), a second cavity (104) and a mating face (101), and includes a first mating tongue (14) extending in the first cavity and a second mating tongue (15) extending in the second cavity. Each side wall includes a flange (110) projecting from a top edge thereof and the two flanges extend toward each other above the first mating tongue. The terminals are respectively disposed in the first and the second mating tongues to electrically engage complementary mating connectors.

12 Claims, 7 Drawing Sheets

STACKED ELECTRICAL CONNECTOR WITH ENHANCED HOUSING STRUCTURE

CROSS-REFERENCE TO RELATED APPLICATIONS

This patent application is a continuation-in-part of U.S. patent application Ser. No. 10/295,737, filed on Nov. 15, 2002, entitled "STACKED ELECTRICAL CONNECTOR". This application relates to a copending application filed on Mar. 26, 2003 having the same applicant the same assignee with the invention, and titled "ELECTRICAL CONNECTOR WITH ENHANCED HOUSING STRUCTURE".

BACKGROUND OF THE INVENTION

1. Field of the Invention

The present invention generally relates to an electrical connector, and particularly to an electrical connector mounted on a printed circuit board.

2. Description of Related Arts

Serial Advanced Technology Attachment (Serial ATA) connectors provide a storage interface for ATAPI (Advanced Technology Attachment Packet Interface) devices and hard disk drives, which are main storage peripheral devices of computer systems. Conventionally, a Serial ATA connector comprises an insulating housing and a plurality of terminals received in the housing. Such Serial ATA connectors can be found in U.S. Pat. No. 6,402,552 and Taiwan Patent Issue Nos. 493301, 493804, and 509393. Generally, the insulative housing of the Serial ATA connector includes a main portion, a mating portion extending from the main portion and receiving the terminals, and one side arm extending from one lateral side of the main portion. The side arm defines an inner groove for guiding insertion of a complementary mating connector. A space is defined between a lateral edge of the mating portion and the adjacent side arm. However, such conventional Serial ATA connectors usually suffer from a breakage over a period of use, under repeated insertion, and withdrawal of a mated cable connector, which will adversely influence the signal transmission. Specifically, the housing will be easily broken along a vertical line on the side arm where the side arm connects to the main portion when the complementary connector is pulled in a right-and-left direction repeatedly. Similarly, the housing will be also easily broken along a horizontal line on the side arm where the side arm connects to the main portion and on the mating portion where the mating portion connects to the main portion when the complementary mating connector is pulled up and down repeatedly. Particularly, when it is required to have a pair of such connectors stacked together, the breakage of the housing will become relatively serious.

Hence, it is desirable to enhance the structural stability of Serial ATA connectors to ensure the signal transmission quality.

BRIEF SUMMARY OF THE INVENTION

Accordingly, it is an object of the present invention to provide a Serial ATA connector having an enhanced housing structure for improving the rigidity of the connector and improving overall connector integrity.

In order to achieve the above-mentioned object, a Serial ATA connector in accordance with the present invention includes an insulative housing, a number of terminals received in the housing, a spacer organizing the terminals, and a pair of board locks secured to the housing. The housing includes a pair of side walls, a partition wall horizontally extending between the two side walls, and a middle wall extending vertically to the partition wall and connecting the two side walls. The housing defines a first cavity, a second cavity and a mating face, and comprises a first mating tongue in the first cavity extending from the middle wall toward the mating face and a second mating tongue in the second cavity extending from the middle wall toward the mating face. The two side walls each comprise a flange projecting therefrom and extending toward each other above the first mating tongue. The terminals are respectively disposed in the first and the second mating tongues to electrically engage complementary mating connectors.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
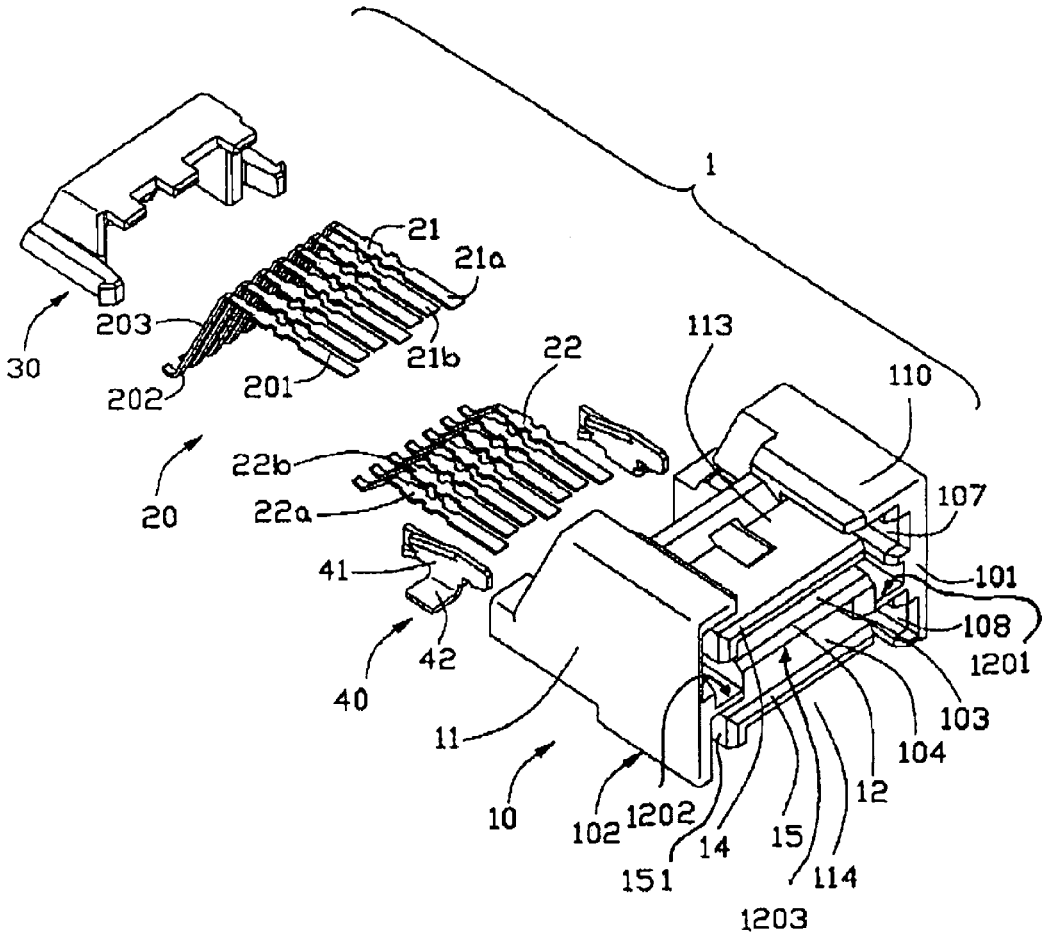
FIG. 1 is an exploded, perspective view of an electrical connector in accordance with the present invention.
Figure 2:
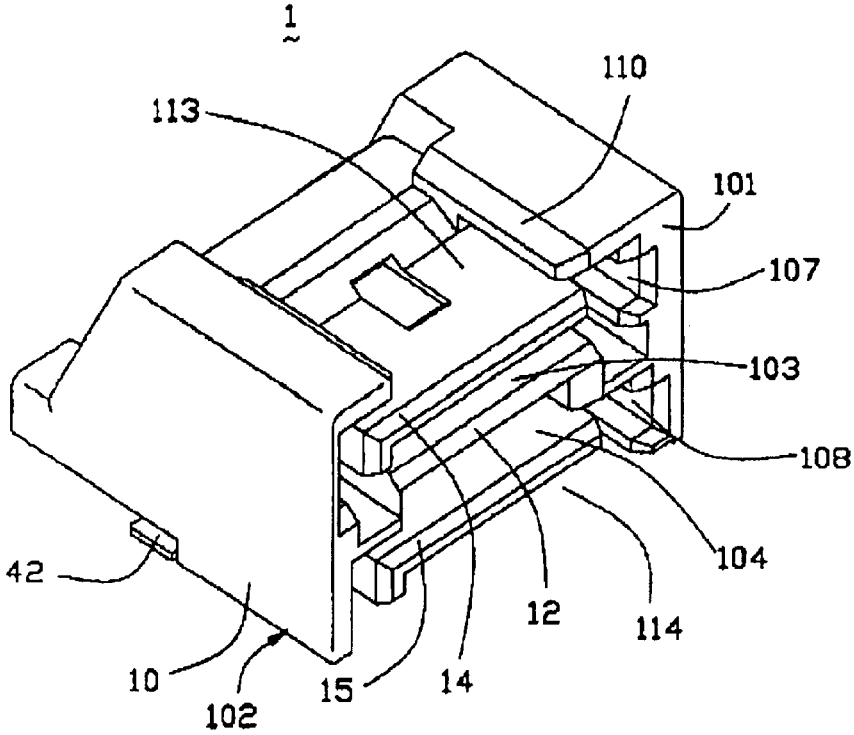
FIG. 2 is an assembled view of FIG. 1.

Reference will now be made to the drawing figures to describe the present invention in detail.

Figure 5:
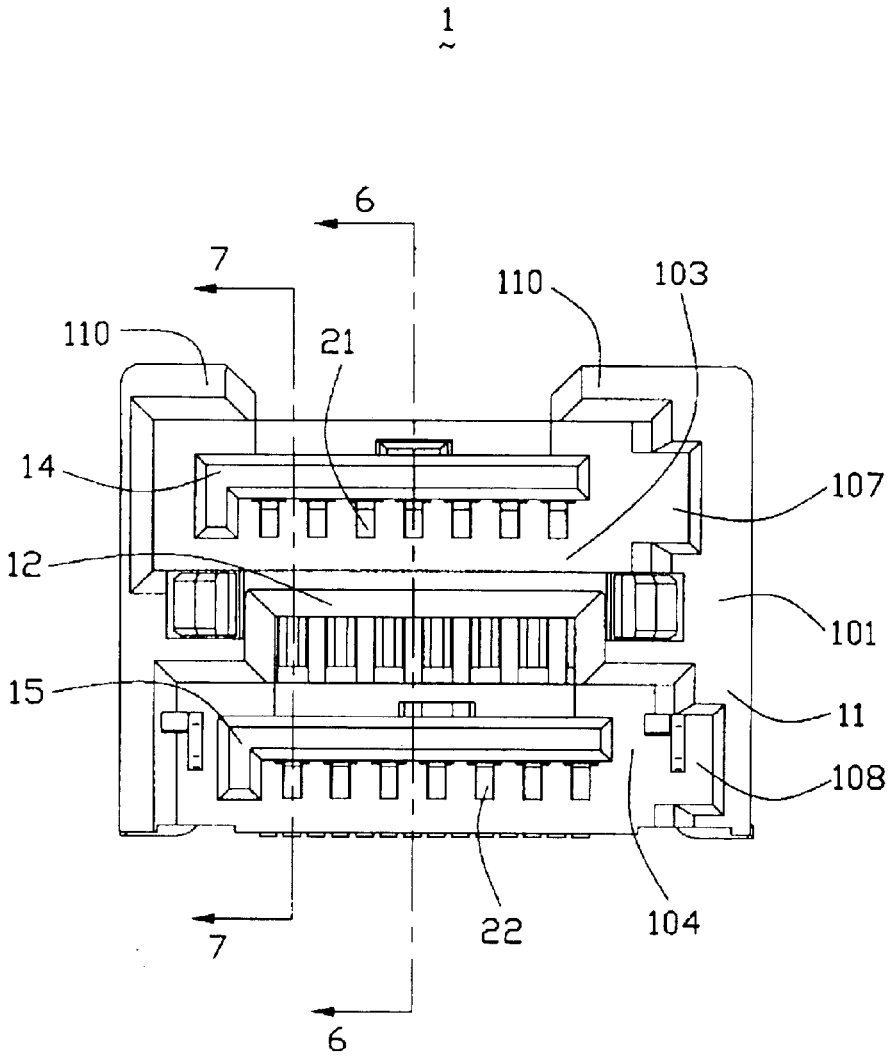
FIG. 5 is a front plan view of FIG. 2.

With reference to FIGS. 1–4, a multiple-port electrical connector 1 in accordance with the present invention, which is mountable on a printed circuit board (not shown), comprises an insulative housing 10, a plurality of terminals 20 disposed in the housing 10, a spacer 30 attached onto the housing 10, and a pair of board locks respectively secured to the housing 10. walls 11 and extending toward each other above the first mating tongue 14 for The insulative housing 10 comprises a pair of side walls 11 extending parallel to each other a partition wall 12 extending horizontally between the two side walls 11, and a middle wall 13 (FIGS. 3 and 4) extending perpendicularly to the partition wall 12 and connecting the two side walls 11. A first cavity 103 and a second cavity 104 are respectively defined by the side walls 11 and the partition wall 12 for receiving corresponding mating complementary connectors (not shown) therein. The insulative housing 10 also defines a mating face 101 on a front side thereof and a board-mounting face 102 on a bottom side thereof, which is orthogonal to the mating face 101. A first mating tongue 14 extends forwardly in the first cavity 103 from the middle wall 13 to the mating face 101. Similarly, a second mating tongue 15 extends forwardly in the second cavity 104 from the middle wall 13 to the mating face 101. The second mating tongue 15 is substantially formed below the first mating tongue 14. Each mating tongue 14, 15 defines a plurality of passageways 105 in a lower surface thereof. Each of said mating tongue 14, 15 defines a vertical section 141, 151. The housing 10 has a top wall (not labeled) and having a first portion 113 which is removed to form a space for allowing an optionally equipped deflectable latch of the mating complementary connector to pass by and to vertically expose the first cavity 103 to an exterior, thereby forming a pair of flanges 110 projecting from top edges of the two side walls 11 and extending toward each other above the first mating tongue 14 for increasing the structural rigidity of the whole housing 10. The functions of the flanges and the space is detailedly described in FIG. 1 and col. 3. para. 3 of U.S. Pat. No. 6,699,049 B1 assigned to the same applicant with the invention and the disclosure of the related patent is wholly incorporated herein by reference. The insulative housing 10 also has bottom wall (not labeled) opposite to the top wall and having a second portion 114 which is removed to vertically expose the second cavity 104 to the exterior. The first portion 113 is smaller than the second portion 114 in a lateral direction of the housing 10 as shown in FIG 1. As best seen in FIG. 5, in the preferred embodiment, the first and the second mating tongues 14, 15 each have an inverted L-shaped configuration. Moreover, one of the two side walls 11 particularly defines a first slot 107 communicating with the first cavity 103 and a second slot 108 communicating with the second cavity 104, which are performed to guide insertions of the mating complementary connectors as well known in the art. It is also noted that that partition wall 12 is configured to define a center lower cutout 1203 in communication with the second cavity 104 for allowing the optionally equipped deflectable latch of the mating complementary connector to extend therethrough, and a pair of side cutouts 1201 and 1202 in communication with the first cavity 103.

Figure 3:
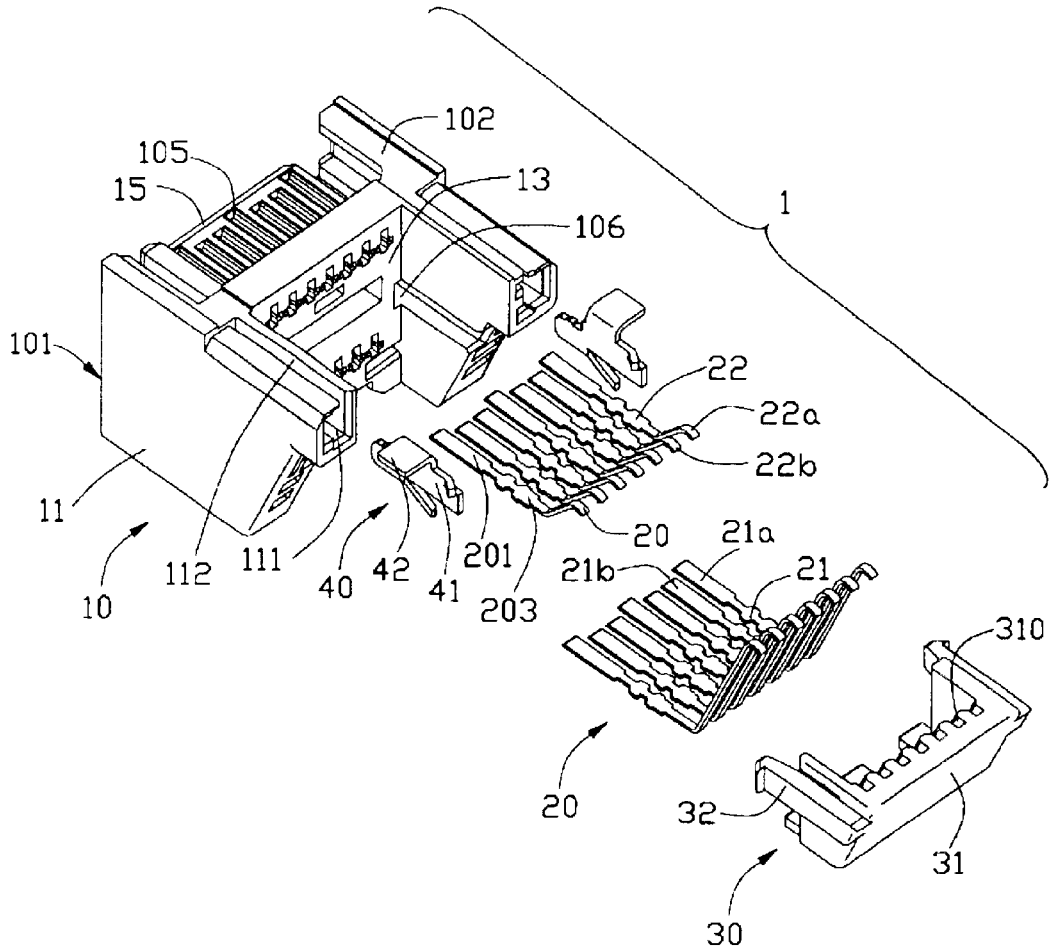
FIG. 3 is another exploded, perspective view of the electrical connector.
Figure 4:
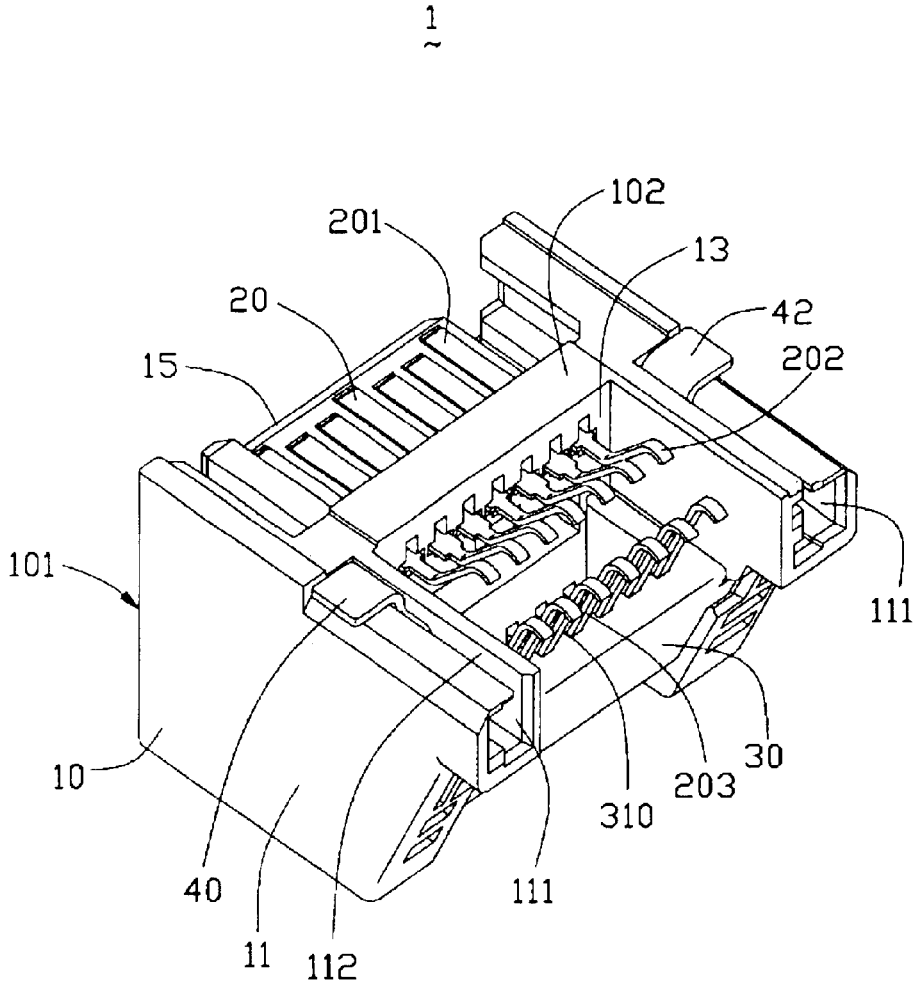
FIG. 4 is an assembled view of FIG. 3.

Particularly referring to FIG. 3, each side wall 11 comprises a channel 111 defined in a bottom side and a slit 112 exposed to the board-mounting face 102 and communicating with the channel 111. The channels 111 and the slits 112 are configured for engaging corresponding board locks 40. The board locks 40 each comprise a housing retaining portion 41 and a mounting pad 42 extending from an edge of the housing retaining portion 41 for soldering to the printed circuit board thereby securing the connector 1 on the printed circuit board. The housing retaining portion 41 is inserted into the channel 111 with the mounting pad 42 extending outwardly through the corresponding slit 112.

Figure 6:
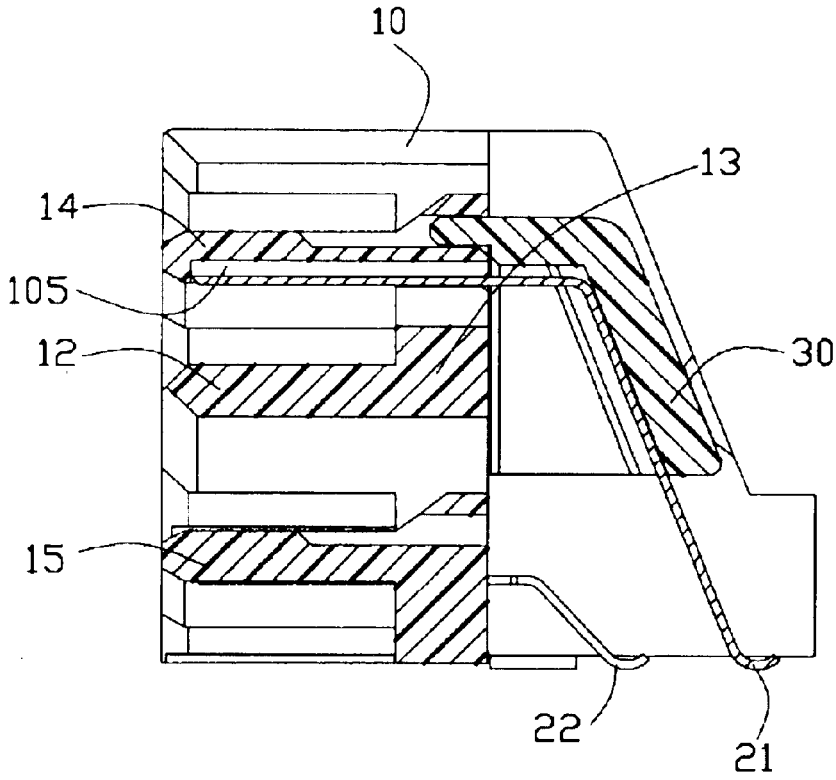
FIG. 6 is a cross-sectional view of the electrical connector taken along section line 6—6 of FIG. 5 to particularly show one of a first array of terminals received in a housing.
Figure 7:
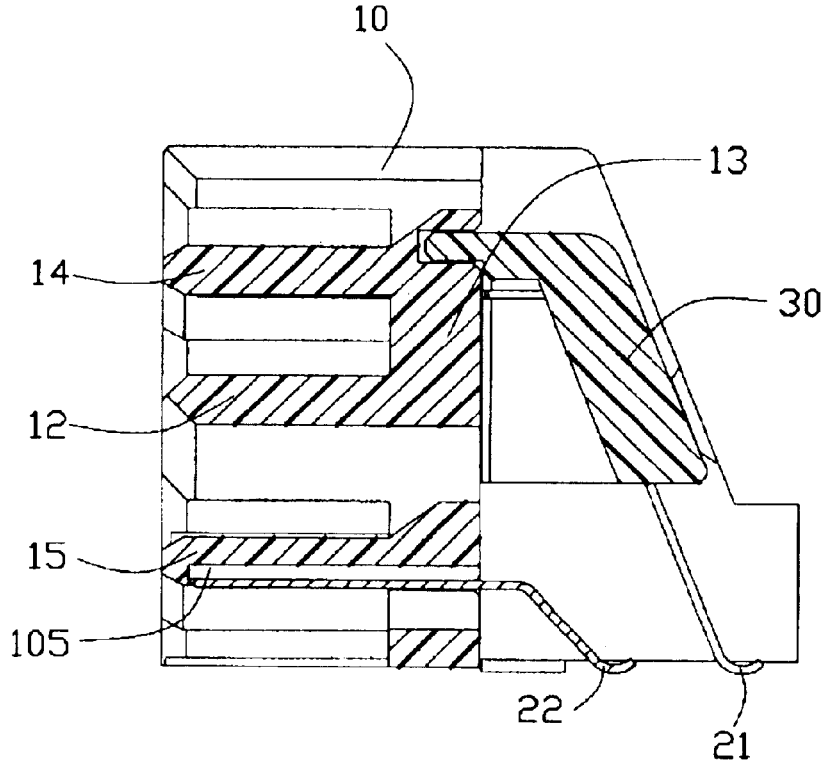
FIG. 7 is another cross-sectional view of the electrical connector taken along section line 7—7 of FIG. 5 to particularly show one of a second array of terminals received in the housing.

Together referring to FIGS. 1 and 3, the plurality of terminals 20 comprise a first or upper array of terminals 21 and a second or lower array of terminals 22. Each terminal 20 comprises a contact portion 201 received in a corresponding passageway 105 of the first/second tongue 14/15 for electrically contacting with the corresponding mating complementary connector, a solder tail 202 for soldering to the printed circuit board and an angled, intermediate portion 203 connecting the contact portion 201 and the solder tail 202. Each array of terminals 21, 22 is categorized with a plurality of ground terminals 21*a*, 22*a* and a plurality of signal terminals 21*b*, 22*b* for transmitting differential signal pairs. The ground terminals 21*a*, 22*a* are longer than the signal terminals 21*b*, 22*b*. As best shown in FIGS. 5–7, the first and the second arrays of terminals 21, 22 are staggerly arranged with respect to each other.

Continuing to FIGS. 1 and 3, the spacer 30 of the connector 1 is configured with an obliquely extending panel 31 and a pair of latches 32 extending forwardly at two opposite sides of the obliquely extending panel 31. The obliquely extending panel 31 defines a plurality of inner grooves 310 in correspondence with the angled, intermediate portions 203 of the first array of terminals 21 to receive therein and organize the angled, intermediate portions 203. The latches 32 of the spacer 30 are correspondingly engaged within a pair of holes 106 (only one shown in FIG. 3) defined in the insulative housing 10 to firmly secure the spacer 30 to the housing 10.

In assembly, the plurality of terminals 20 are retained in the insulative housing 10 with the contact portions 201 correspondingly received in the passageways 105. The spacer 30 is assembled to the insulative housing 10 with the two latches 32 engaging within the holes 106 and the inner grooves 310 receiving corresponding angled, intermediate portions 203 of the terminals 20. The board locks 40 are fixed into the housing 10 with the mounting pads 42 extending outwardly through the corresponding slits 112. Finally, the solder tails 202 of the terminals 20 and the mounting pads 42 of the board locks 40 are respectively soldered onto the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector adapted for mounting on a printed circuit board, comprising:

an insulative housing comprising a pair of side walls each have a flange projecting from a top edge thereof and extending toward each other above a first mating tongue, a partition wall extending horizontally between the side walls and a middle wall extending perpendicularly to the partition wall, the housing defining a first cavity, a second cavity and a mating face, the housing comprising the first mating tongue extending in the first cavity from the middle wall to the mating face and a second mating tongue extending in the second cavity from the middle wall to the mating face;

a first and a second row of terminals disposed in the first and second mating tongues, respectively; and a spacer secured to the housing.

2. The electrical connector as described in claim 1, wherein the first and the second mating tongues are respectively configured in an inverted "L" shape.

3. The electrical connector as described in claim 2, wherein one of the two side walls defines a first slot and a second slot respectively communicating with the first cavity and the second cavity.

4. The electrical connector as described in claim 1, wherein the insulative housing comprises a board-mounting face orthogonal to the mating face, and wherein each of the first and second mating tongues defines a plurality of passageways in a lower surface thereof.

5. The electrical connector as described in claim 4, wherein the first and second arrays of terminals are staggeredly arranged, and wherein each terminal comprises a contact portion received in a corresponding passageway, a solder tail extending to the board-mounting face for being soldered on the printed circuit board, and an intermediate portion connecting the contact portion and the solder tail.

6. The electrical connector as described in claim 5, wherein the intermediate portions of the terminals obliquely extend between respective contact portions and solder tails, and wherein the spacer defines a plurality of inner grooves for correspondingly receiving the intermediate portions of one of the first and the second rows of terminals to guide the solder tails to the board-mounting face.

7. The electrical connector as described in claim 6, wherein the spacer comprises at least one latch device and the insulative housing defines at least one hole for correspondingly receiving the at least one latch device.

8. The electrical connector as described in claim 1, further comprising a pair of board locks, each board lock comprising a mounting pad for mounting on the printed circuit board.

9. The electrical connector as described in claim 8, wherein the insulative housing defines a pair of channels in a bottom side thereof and a pair of slits communicating with corresponding channels, and wherein the board locks are correspondingly received in the channels with the mounting pads extending outwardly through the slits.

10. An electrical connector comprising:

an insulative housing defining two side walls, a partition wall extending horizontally between said side walls, said partition wall cooperating with said side walls to define upper and lower cavities; and upper and lower mating tongues extending horizontally in said upper and lower cavities, respectively; wherein said partition wall defines a center cutout in communication with the lower cavity, and a pair of side cutouts located beside while not in communication with said center cutout but in communication with the upper cavity.

11. An electrical connector comprising:

an insulative housing defining two side walls, a partition wall extending horizontally between said side walls, said partition wall cooperating with said side walls to define upper and lower cavities; and upper and lower L-shaped mating tongues extending horizontally in said upper and lower cavities, respectively;

said housing including a top wall above said upper cavity and a bottom wall below said lower cavity, and a first portion of the top wall being removed to vertically expose the upper cavity to an exterior and a second portion of the bottom wall being removed to vertically expose the lower cavity to the exterior; wherein the first portion is smaller than the second portion in a lateral direction of the housing.

12. The connector as described in claim 11, wherein said partition wall is vertically offset with more than one sections along the lateral direction of said connector.

* * * * *